United States Patent [19]

Ridgway

[11] Patent Number: 5,035,128

[45] Date of Patent: Jul. 30, 1991

[54] ANTI-ROTATION LOCK APPARATUS FOR INSIDE DEADBOLT LOCKS

[76] Inventor: David R. Ridgway, 6949 E. Oberlin, Tucson, Ariz. 85710

[21] Appl. No.: 585,801

[22] Filed: Sep. 20, 1990

[51] Int. Cl.[5] ..... E05B 13/08

[52] U.S. Cl. ..... 70/211; 70/416

[58] Field of Search ..... 70/416, 429, 430, 211

[56] References Cited

U.S. PATENT DOCUMENTS

| | | | |
|---|---|---|---|
| 817,962 | 4/1906 | Dengler . | |
| 836,850 | 11/1906 | Younglove . | |
| 874,688 | 12/1907 | Lee . | |
| 996,847 | 7/1911 | Gavin . | |
| 1,055,510 | 3/1913 | Birkle, Jr. | 70/429 |
| 1,079,860 | 11/1913 | Kiehl . | |
| 1,167,342 | 1/1916 | Fraser . | |
| 1,467,057 | 9/1923 | Moglich . | |
| 1,538,050 | 5/1925 | Mark . | |
| 1,571,543 | 2/1926 | Fratzke . | |
| 1,627,709 | 5/1927 | Menchen . | |
| 1,671,454 | 5/1928 | Stoutenburgh . | |
| 1,869,689 | 8/1932 | Holland . | |
| 1,971,440 | 8/1934 | Aubertin | 292/292 |
| 2,396,982 | 3/1946 | Bousquet | 292/289 |
| 2,463,195 | 3/1949 | Mungan | 70/416 |
| 3,596,961 | 8/1971 | Lippman | 292/292 |
| 3,862,556 | 1/1975 | Moses | 70/416 |
| 3,913,962 | 10/1975 | Briggs | 292/292 |
| 4,043,578 | 8/1977 | Downs | 292/290 |
| 4,135,748 | 1/1979 | Roberts | 292/298 |
| 4,326,394 | 4/1982 | Stein | 70/292 |
| 4,330,146 | 5/1982 | Sessions, Jr. | 292/292 |
| 4,387,919 | 6/1983 | Quaintance | 292/296 |
| 4,578,970 | 4/1986 | Youngblood et al. | 70/428 |
| 4,603,895 | 8/1986 | Langenbahn | 292/295 |
| 4,607,253 | 8/1986 | Wooten et al. | 340/292 |
| 4,653,786 | 3/1987 | Bopst | 292/295 |
| 4,657,293 | 4/1987 | Bell | 292/258 |
| 4,715,200 | 12/1987 | Katsaros | 70/416 X |
| 4,819,461 | 4/1989 | Pearson | 70/14 |

FOREIGN PATENT DOCUMENTS

| | | | |
|---|---|---|---|
| 15009 | 9/1881 | Fed. Rep. of Germany | 70/430 |
| 513332 | 11/1930 | Fed. Rep. of Germany | 70/211 |
| 380949 | 10/1907 | France | 70/429 |
| 433431 | 1/1912 | France | 70/429 |

*Primary Examiner*—Lloyd A. Gall

*Attorney, Agent, or Firm*—H. Gordon Shields

[57] ABSTRACT

Anti-rotation lock apparatus prevents the rotation of a deadbolt key or handle by holding the key or handle from the inside of a door. The apparatus includes a base element which fits over the key or lock handle and an extension which extends from the base element and which is braced against the doorknob or doorknob assembly to prevent rotation of the base element and of the key or handle on which the base element is disposed.

7 Claims, 2 Drawing Sheets

ANTI-ROTATION LOCK APPARATUS FOR INSIDE DEADBOLT LOCKS

BACKGROUND OF THE INVENTION

1. Field of the Invention

This invention relates to inside deadbolt locks and, more particularly, to apparatus for preventing keys and handles of dead bolt locks from turning.

2. Description of the Prior Art

As is well known and understood, the history of locks goes back to antiquity. Ancient Greece, and ancient Rome, and other civilizations, all utilized some types of locks. The use of deadbolt locks is of more recent vintage.

Very briefly, a deadbolt lock is simply a lock that requires a key for both locking and unlocking. There is no spring element involved in a deadbolt lock.

Deadbolt locks are typically used as an extra precaution in securing a door against possible intrusion that may occur with a typical springloaded lock set in which both the inside and the outside handles or knobs turn.

In addition to different patented locks, themselves, various elements have been developed over the years to prevent a door from opening independently of a lock. The following patents illustrate elements to prevent a door from opening to the inside and all of the elements are independent of the locks themselves:

| | | |
|---|---|---|
| 817,962 | E. Dengler | April 17, 1906 |
| 836,850 | T. Younglove | Nov. 27, 1906 |
| 874,688 | A. Lee | Dec. 24, 1907 |
| 996,847 | J. Gavin | July 4, 1911 |
| 1,079,860 | G. Kiehl | Nov. 25, 1913 |
| 1,167,342 | J. Fraser | Jan. 4, 1916 |
| 1,467,057 | A. Moglock | Sept. 4, 1923 |
| 1,538,050 | J. Mark | May 19, 1925 |
| 1,571,543 | G. Fratzke | Feb. 2, 1926 |
| 1,627,709 | J. Menchen | May 10, 1927 |
| 1,671,454 | E. Stoutenburgh | May 29, 1928 |
| 1,869,689 | J. Holland | Aug. 2, 1932 |
| 1,971,440 | O. Aubertin | Aug. 28, 1934 |
| 2,396,982 | J. Bousquet | March 19, 1946 |
| 3,596,961 | A. Lippman | Aug. 3, 1971 |
| 3,913,962 | K. Briggs | Oct. 21, 1975 |
| 4,043,578 | E. Downs | Aug. 23, 1977 |
| 4,135,748 | C. Roberts | Jan. 23, 1979 |
| 4,326,394 | F. Stein | April 27, 1982 |
| 4,330,146 | E. Sessions, Jr. | May 18, 1982 |
| 4,387,919 | L. Quaintance et al | June 14, 1983 |
| 4,603,895 | A. Langenbahn | Aug. 5, 1986 |
| 4,653,786 | J. Bopst, III | March 31, 1987 |

U.S. Pat. No. 4,607,253 (Wooten et al) discloses a jamming mechanism which extends between the door and the floor for preventing the door from opening.

U.S. Pat. No. 4,657,293 (Bell) discloses another type of device that fastens to the door jamb and to the floor to prevent the door from opening.

U.S. Pat. No. 4,578,970 discloses a cabinet which fits around a doorknob to prevent access to the doorknob from the outside of a building.

U.S. Pat. No. 4,819,461 (Pearson) discloses a lock for locking the tailgate of a pickup truck by utilizing a bar which is locked in place over the tailgate handle and through a hole in the rear bumper of the vehicle.

The apparatus of the present invention, rather than including separate apparatus for preventing a door from opening, is designed for use with deadbolt locks and which is used to prevent either a key or a deadbolt latch handle from rotating so that the door lock itself is locked in place. The apparatus is relatively inexpensive to manufacture and is relatively simple to use.

SUMMARY OF THE INVENTION

The invention described and claimed herein comprises a hook element having a pair of arms with a relatively shallow enclosed angle between the pair of arms which receives a rotating element, such as a key or a deadbolt lock handle. Extending downwardly or outwardly from one of the arms is a handle or extension element which may be disposed against a door handle to provide the leverage for preventing the rotation of the rotating element. Another extension element may be used in case there is a substantial distance between the rotative element and the door handle.

Among the objects of the present invention are the following:

To provide new and useful apparatus for preventing the rotation of a key or a handle of a deadbolt lock;

To provide new and useful apparatus for maintaining a key or a lock handle in a predetermined orientation;

To provide new and useful apparatus for receiving a key or a deadbolt lock handle;

To provide new and useful apparatus for securing a key or a deadbolt handle in position relative to a separate doorknob;

To provide a two-armed element having a relatively shallow acute angle between the two arms for receiving a key;

To provide new and useful generally V-shaped element for receiving a handle of a deadbolt and an extension element which may be secured to one of the arms to prevent the rotation of the V-shaped element by jamming the extension element against a doorknob; and To provide new and useful apparatus for preventing a deadbolt handle from turning which includes a handle receiving element and an extension bar securable to the handle receiving element.

DESCRIPTION OF PREFERRED EMBODIMENT

Figure 1:
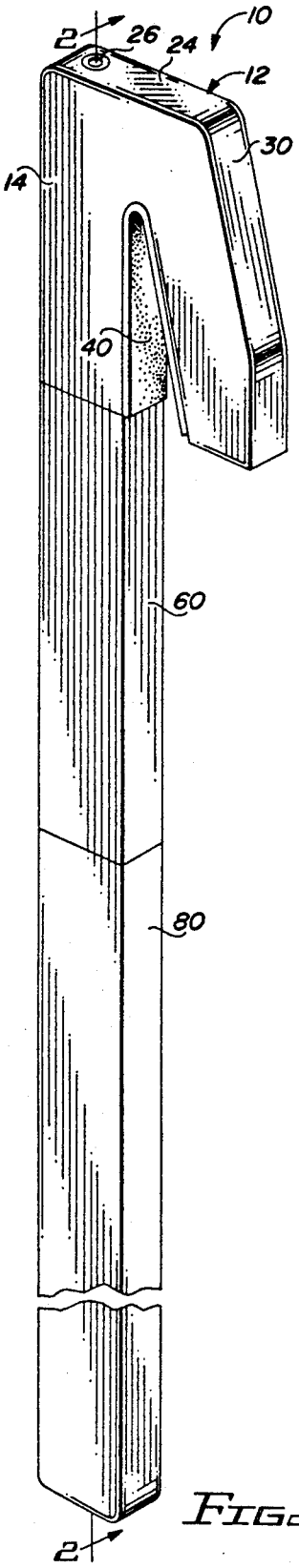
FIG. 1 is a perspective view of the apparatus of the present invention.
Figure 2:
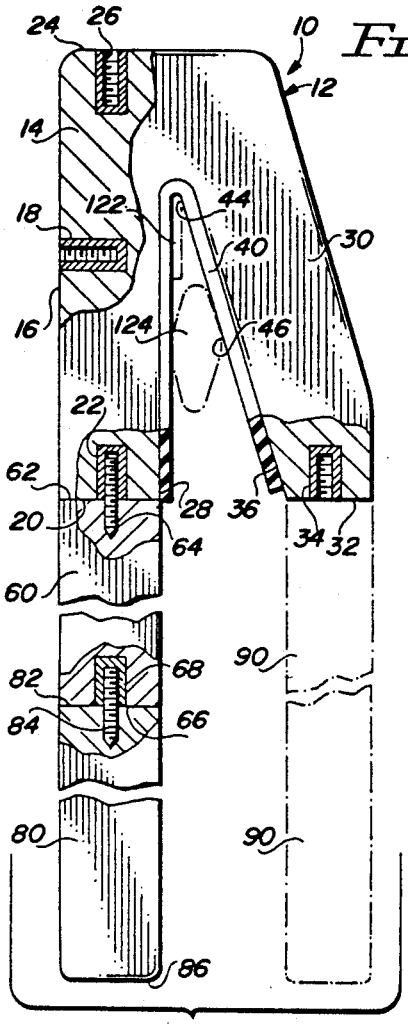
FIG. 2 is a side view in partial section of the apparatus of the present invention assembled in one embodiment.

FIG. 1 is a perspective view of anti-rotation lock apparatus 10 of the present invention. FIG. 2 is a side view, in partial section, of the anti-rotation lock apparatus 10 of FIG. 1. For the following discussion of the lock apparatus 10, reference will primarily be made to FIGS. 1 and 2.

The anti-rotation lock apparatus 10 includes a base element 12 and two extension bars 60 and 80 secured to the base element. In FIG. 2, an additional long extension bar 90 is shown in dotted line also secured to the base element 12.

The base element 12 includes a base leg 14 and angled leg 30 secured together. The base leg 14 has a generally rectangular configuration, including an outside surface 16, with a tapped insert 18 extending into the base leg 14 through the outside surface 16, a bottom 20, with a tapped insert 22 extending into the base element 12 through the bottom 20, and a top or top surface 24. The top surface 24 is generally perpendicular to the outside surface 16 and is generally parallel to the bottom surface 20. The top surface 24 also comprises the top surface of the angled leg 30.

A tapped insert 26 extends downwardly into the base leg 14 through the top surface 24. The tapped insert 26 comprises one of a plurality of such inserts at different locations at which an extension element may be selectively secured. The tapped apertures comprise sockets for receiving a mating element on an extension bar. The specific location at which an extension bar will be secured to the base element will depend on the orientation of a deadbolt lock and a doorknob on a particular door. This will be discussed in detail below.

The angled leg 30 extends downwardly from the top surface 24 and outwardly at an angle of about fifteen degrees from the base leg 14. That is, there is an angle of about 15 degrees between the leg 14 and the leg 30.

The angled leg 30 includes a bottom 32 which is generally parallel to and aligned with the bottom 20 of the base leg 14. The bottom 32 is also generally parallel to the top 24. A tapped insert 34 extends upwardly into the base leg 30 from the bottom surface 32.

The base leg 14 includes an inner surface 28, and the angled leg 30 includes an inner surface 36. The surfaces 28 and 36 are, again, at an angular orientation of about 15 degrees to each other. A liner 40, which is preferably rubber, or the like is disposed relatively continuously on the inner surfaces 28 and 36 between the legs 14 and 30. The liner 40 preferably has a high coefficient friction and is somewhat resilient. There is a nominal thickness to the liner 40 for purposes of convenience.

The purpose of the relatively high co-efficient of friction of the liner 40 is to help the apparatus 10 hold on or stay on the rotating element of the lock on which it is disposed and whose rotation the apparatus 10 is designed to prevent. This will be discussed below.

As best shown in FIG. 1, there is a thickness to the apparatus 10 of about ¾ of an inch or about twenty millimeters. The reason for the thickness of the base element 12 will be discussed in detail below in conjunction with the figures illustrating the use environment of the apparatus 10.

At the juncture of the legs 14 and 30 with respect to the liner 40, or at the top bend of the liner 40, there is a top notch 44 defined. The notch, or the area immediately below the notch, will receive the lock's rotating element. The exact location of the rotating element in the notch will depend on the thickness or width of the rotating element. For example, a thin key will fit higher in the notch 44 than will a relatively thick handle or knob. In FIG. 2, a key 122 is shown in dotted line disposed in the notch 44. Below the notch 44 is an intermediate area 46. A deadbolt knob 124 is shown in FIG. 2 in dotted line disposed in the intermediate area 46.

Two extension bars 60 and 80 are shown in FIG. 1 extending downwardly from the base leg 14. The extension bar 60 is shown secured directly to the base leg 14, and the extension bar 80 is shown secured to the extension bar 60. In FIG. 2, the extension bar 60 and the extension bar 80 are shown in partial section, illustrating the manner of securing together the three elements, the base element 12 and extension bars 60 and 80.

The extension bar 60 is of a generally rectangular configuration, substantially identical in general configuration to that of the base leg 14. Similarly, the extension bar 80 is of the same generally rectangular configuration as the extension bar 60 and as the base leg 14. Thus, when the extension bars 60 and 80 are secured to each other and to the base leg 14, they are substantially aligned to provide a relatively unitary anti-lock rotation apparatus, with the extensions 60 and 80 comprising simply continuations of the base leg 14.

The base leg 60 includes a top 62 with a screw insert 64 secured to the top 62 or extending outwardly therefrom. The extension bar 60 also includes a bottom 66, and a tapped insert 68 extends inwardly from the bottom 66.

Extension bar 80 includes a top 82 and a screw insert 84 extends outwardly from the top 82. The extension bar 80 also includes a bottom 86.

In FIG. 2, the screw insert 64 is shown extending into the tapped insert 22 of the bottom 20 of the base leg 14. Similarly, the screw insert 84 of the extension 80 is shown extending into the tapped insert 68 of the bottom 66 of the extension 60. Thus, when assembled, the screw extensions extend in a mating engagement into the tapped apertures.

In FIG. 2, the long extension bar 90 is similarly shown extending downwardly from the surface 32 of the leg 30. The extension 90 is simply a longer version of the extension 80, or a single extension bar in place of the two shorter extension bars 60 and 80, with a screw insert extending upwardly for mating engagement with any of the tapped inserts in the base element 12, such as the tapped insert 34. Obviously, if desired, the long extension 90 could also be secured to any of the other tapped inserts of the base element 12 or of the extension 60.

It will also be noted that instead of a single long extension bar 90, the tapped insert 34 could receive the extension bar 80 for storage and transport purposes. In most circumstances, or use environments, as illustrated in FIGS. 3–10, only a single extension bar is needed and used. Accordingly, a single long extension bar, such as the bar 90, may not be needed under most circumstances.

FIGS. 3–11 are side views of the anti-rotation lock apparatus 10 in different use environments, illustrating the various configurations of the apparatus according to the use embodiments attention will be directed to each of the Figures as appropriate.

Figure 3:
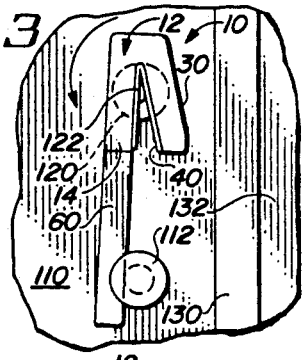
FIG. 3 is a side view illustrating the apparatus of FIG. 2 in a use environment.

In FIG. 3, the apparatus 10 is assembled in the configuration illustrated in FIGS. 1 and 2, but with only the extension bar 60 secured to the leg 14. The apparatus 10 is shown in one use environment. In the use environment of FIG. 3, a door 110 is shown adjacent to a door jamb 130 and a wall 132. A door 110 includes a doorknob or doorknob assembly 112. Disposed above the doorknob 112 is a deadbolt lock 120. The deadbolt lock 120 is shown with a rotating element, namely a key 122. The key 122 is disposed within the top notch 44 of the liner 40 between the legs 14 and 30 of the apparatus 10. The extension 60 is disposed against the doorknob or doorknob assembly 112.

Keys and doorknobs or handles come in different sizes, and it is desirable that the base element 12 be disposed on such rotating elements as securely as possible. Hence it is advantageous that the base element 12 be thick enough to receive such a rotating element regardless of its size without slipping or vibrating off. In other words, the base element 12 is thick enough or wide enough to receive and remain on a rotating element regardless of how large or small the rotating element is.

As is well known and understood, doorknobs extend outwardly from the door, and there is a space between the rear of the knob and the door itself, and a shaft connects the doorknob to the door, or to the lock within the door. The doorknob, shaft, etc., are part of the doorknob assembly. The extension 60 is disposed between the door 110 and the knob 112, or against the shaft between the doorknob and the door. For convenience herein, reference to "doorknob 112" refers to the doorknob assembly, and specifically to the rear portion of the doorknob and the shaft between the doorknob itself and the door. That is, the extension bar 60 is braced against the rear of the doorknob and the shaft between the doorknob and the door.

A relatively large curved arrow illustrates the normal direction of rotation of the key 122 for purposes of unlocking the deadbolt lock 120. In the configuration illustrated, the apparatus prevents the rotating element, such as the key 122, from being rotated in the deadbolt lock 120. Thus, the apparatus 10 defines an anti-rotation lock apparatus to prevent the rotation of the key 122 so that with a key, or otherwise, a person on the outside of the door 110 could not rotate the deadbolt 120 as long as the apparatus 10 is disposed on the key 122 and braced against the doorknob 112.

Figure 4:
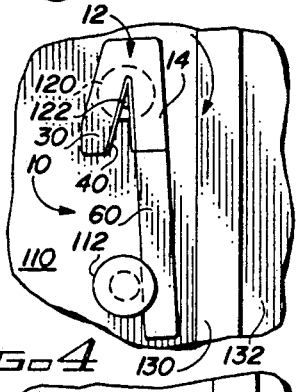
FIG. 4 is a side view of the apparatus of FIGS. 1, 2, and 3 in another use environment.

In FIG. 4, the apparatus 10 in the same configuration as illustrated in FIG. 3 is reversed with respect to the key 122 and the doorknob 112. That is, FIG. 4 is a virtual mirror image of FIG. 3. The relatively large curved arrow illustrates the direction of rotation of the key 122 for purposes of unlocking the deadbolt lock 120. As illustrated in FIG. 4, the extension 60 is disposed against the doorknob 112 or against the connecting shaft between the doorknob 112 and the door 110 to brace the base element 12 against the rotation of the key 122. Then, the apparatus 10 prevents the rotation of the key 122, and thus of the lock 120.

Figure 5:
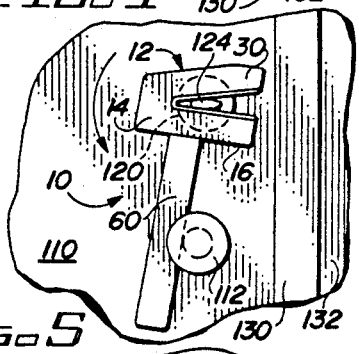
FIG. 5 is a side view of the apparatus of the present invention assembled in another configuration for another use environment.

In FIG. 5, the extension bar 60 is shown secured to the surface 16 of the base leg 14 of the base element 12. Thus, referring again to FIG. 2, the screw extension 64 of the extension bar 60 is threadedly inserted into the tapped insert 18 of the surface 16. An alternate rotating element, a handle 124 instead of the key 122 of FIGS. 3 and 4, is disposed in the intermediate area 46 of the insert 40, and the extension 60 is disposed against the knob 112, or against the shaft of the knob 112, so as to prevent rotation of the handle 124 of the deadbolt 120. The large curved arrow illustrates the direction of rotation of the knob 124 to unlock the deadbolt lock 120. With the apparatus 10 secured to the handle 124, and against the knob 112, rotation of the handle 124 is prevented so that the deadbolt lock 120 cannot be unlocked from outside the door 110.

It will be noted that the inside rotating element for the deadbolt lock 120 in FIG. 2 is also the handle 124.

Figure 6:
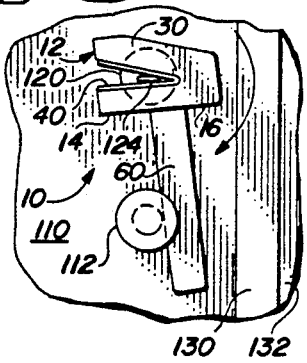
FIG. 6 is a side view of the apparatus of FIG. 5 in another use environment.

In FIG. 6, the apparatus 10 and the configuration illustrated in FIG. 5 is disposed on the handle 124 in essentially the mirror image as shown in FIG. 5. The apparatus 10 is accordingly simply reversed to prevent rotation of the handle 124 in the opposite direction of that shown in FIG. 5. In FIG. 6, the large curved arrow illustrates the direction of rotation of the handle 124 to unlock the deadbolt 120. With the extension bar 60 exposed against the doorknob 112, or against the assembly of which the door-knob is a part, rotation of the handle 124 is prevented.

Figure 7:
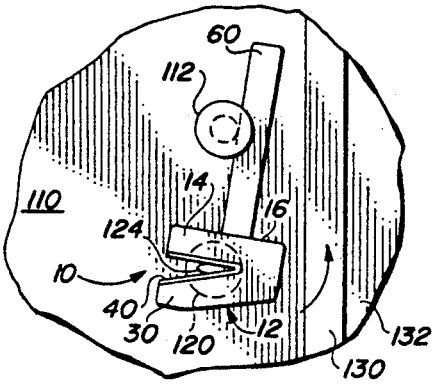
FIG. 7 is a side view of the apparatus of FIG. 5 in another use environment.
Figure 8:
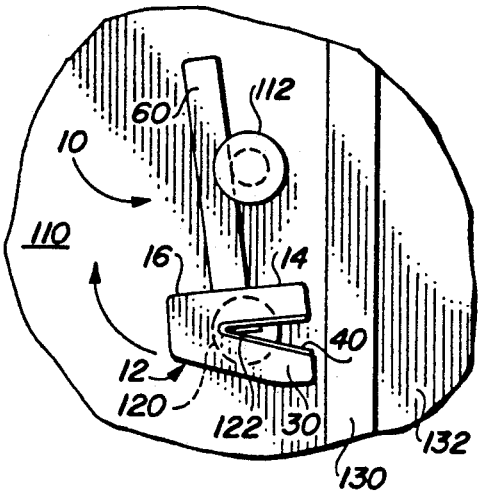
FIG. 8 is a side view of the apparatus of FIG. 5 in another use environment.

In FIGS. 3, 4, 5, and 6, the deadbolt lock 120 is shown disposed above the door handle 112. In FIGS. 7 and 8, the deadbolt lock 120 is shown disposed below the doorknob 112. The apparatus 10, in the general configuration illustrated in FIGS. 5 and 6, is shown essentially inverted in FIGS. 7 and 8. The apparatus 10, inverted, prevents rotation of the handle 124 in FIG. 7 and the key 122 in FIG. 8 in the directions illustrated by the large curved arrow. Again, the extension 60 is disposed against the doorknob 112, or against the assembly of which the doorknob 112 is a part, to act as a stop element to prevent rotation of the base element 12 when the handle 124 is disposed within the liner 40 of the base element 12.

FIG. 8 is virtually a mirror image of FIG. 7. In both FIGS. 7 and 8, the base element 12 is oriented substantially perpendicularly to that shown in FIGS. 1-4, with the Legs 14 and 30 extending generally horizontally. The horizontal orientation of FIGS. 7 and 8 is the inverted orientation of the showing of FIGS. 5 and 6.

Figure 9:
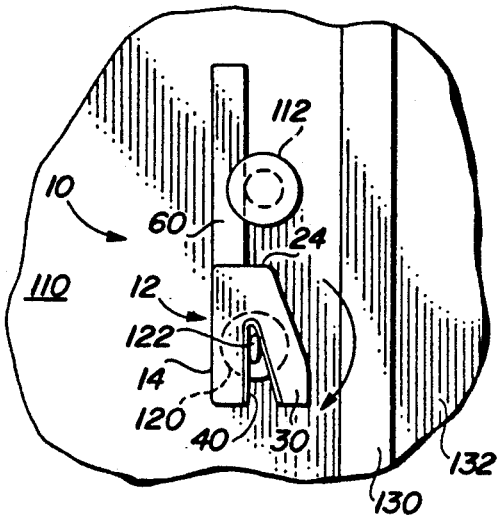
FIG. 9 is a side view of the apparatus of the present invention assembled in another configuration for another use environment.
Figure 10:
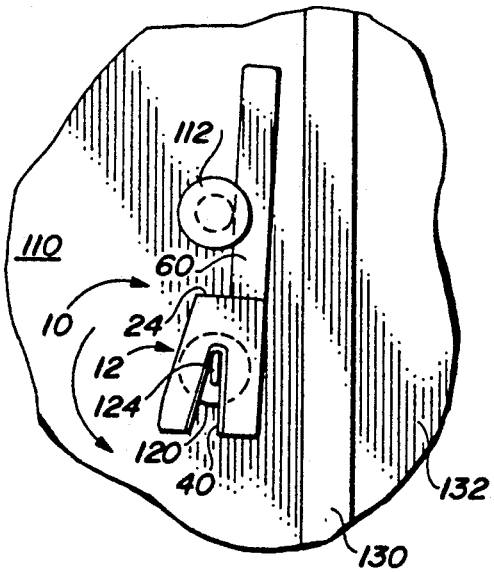
FIG. 10 is a side view of the apparatus of FIG. 9 in another use environment.

In FIGS. 9 and 10, the doorknob 112 is shown again disposed above the deadbolt lock 120, and the extension bar 60 is shown secured to the top surface 24 of the base element 12. Thus, referring again to FIG. 2, the screw insert 64 of the extension bar 60 is secured to the tapped insert 26 of the top 24 of the base element 12. As shown, the extension 60 comprises essentially an extension of the base leg 14 but upwardly from the top surface 24.

A key 122 is shown disposed within the top notch 44 of the liner 40 between the legs 14 and 30 in FIG. 9. The extension 60 is shown disposed against the doorknob assembly 112 to prevent rotation of the key 122 in the direction shown by the large curved arrow.

In FIG. 10, substantially the same environment as illustrated in FIG. 9 is found, but the direction of rotation of the lock is reversed. The handle 124 is shown disposed within the liner 40, and prevention of the handle 124 from rotating in the direction of the large arrow is illustrated by the extension bar 60 disposed against the doorknob 112. The environment of FIG. 10, with respect to the apparatus 10, is essentially a mirror image of FIG. 9. That is, the apparatus 10 is simply turned over or rotated 180 degrees, to comprise a mirror of the illustration of FIG. 9 to prevent the rotation of the handle 124 of the deadbolt lock 120.

Figure 11:
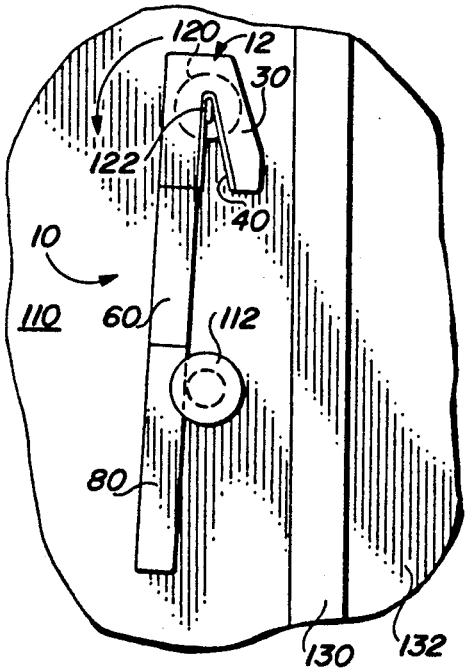
FIG. 11 is a side view of the apparatus of the present invention assembled in the configuration of FIG. 1 for another use environment.

FIG. 11 illustrates a generally similar use environment of the apparatus 10 to that shown in FIGS. 2 and 3, however, in FIG. 11 there is substantial distance between the handle 112 and the deadbolt lock 120. Accordingly, the extension 80 is secured to the bottom of extension 60 and it is the extension 80 which is disposed against the door knob 112 or against the assembly of which doorknob 112 is a part.

Under some circumstances, it may be desirable to utilize a single relatively large extension, such as the extension 90, in place of the two extensions 60 and 80. Accordingly, a single relatively long extension may be employed in place of two shorter extensions.

Referring again to FIG. 2, it is obvious that extension 80 may be secured to the insert 34 on the Leg 30 for storage and transport purposes if only two extension bars are desired. Thus, the extension 60 may be secured to the Leg 14 and the extension 80 may be secured to the Leg 30 for transport and storage purposes.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. For doors having a handle and a lock with a rotating element, apparatus for preventing the rotation of the rotating element, comprising in combination:

base element means secured to the rotating element of the lock, including a generally V-shaped element having a base leg and an angled leg disposed at an acute angle to the base leg, the base leg and the angled leg defining a notch for receiving the rotating element; and extension means selectively securable to the base leg and to the angled leg of the base element means and disposed against the handle to prevent the rotation of the rotating element.

2. The apparatus of claim 1 in which the base element means further includes an angle of about fifteen degrees between the base leg and the angled leg.

3. The apparatus of claim 1 in which the base element means further includes a liner secured to the base leg and to the angled leg and having a relatively high coefficient of friction.

4. The apparatus of claim 1 in which the base element means includes a plurality of locations at which the extension means may be secured to have the extension means in alignment with the base leg, parallel to the base leg from the angled leg, and perpendicular to the base leg.

5. The apparatus of claim 4 in which the base element means includes a socket element at each of the plurality of locations, and the extension means includes an element for extending into a socket element to secure the extension means to the base element means.

6. The apparatus of claim 1 in which the extension means includes a first extension bar, securable to the base element means and a second extension bar securable to the first extension bar.

7. The apparatus of claim 1 in which the base element means includes a plurality of first securing means for securing the extension means to the base element means, and the extension means is securable to the base element means at any of the plurality of first securing means.

* * * * *